US006314616B1

(12) United States Patent
King

(10) Patent No.: US 6,314,616 B1
(45) Date of Patent: Nov. 13, 2001

(54) CABINET DOOR SECUREMENT SYSTEM FOR A FACE FRAME CABINET

(76) Inventor: Ron E. King, 1545 River Park Dr., Suite 450, Sacramento, CA (US) 95815

( * ) Notice: Subject to any disclaimer, the term of this patent is extended or adjusted under 35 U.S.C. 154(b) by 0 days.

(21) Appl. No.: 09/542,982

(22) Filed: Apr. 4, 2000

Related U.S. Application Data

(63) Continuation-in-part of application No. 09/181,434, filed on Oct. 28, 1998.

(60) Provisional application No. 60/129,100, filed on Apr. 13, 1999.

(51) Int. Cl.[7] ..... E50D 5/00

(52) U.S. Cl. ..... 16/382; 312/326; 16/237

(58) Field of Search ..... 16/271, 272, 382, 16/235–237; 312/326–329

(56) References Cited

U.S. PATENT DOCUMENTS

| | | | | |
|---|---|---|---|---|
| Re. 30,717 | | 8/1981 | Dargene | 16/135 |
| Re. 36,213 | | 6/1999 | Lautenschläger, Jr. et al. | 16/249 |
| 3,524,216 | * | 8/1970 | Fernandez et al. | 16/128 |
| 3,590,419 | * | 7/1971 | Dargene | 16/135 |
| 3,749,465 | * | 7/1973 | Newcomer | 312/245 |
| 4,045,841 | * | 9/1977 | Rock et al. | 16/129 |
| 4,517,706 | | 5/1985 | Lautenschläger, et al. | 16/238 |
| 4,615,072 | | 10/1986 | Lautenschläger, Jr. et al. | 16/238 |
| 4,698,877 | | 10/1987 | Lautenschläger, Jr. et al. | 16/235 |
| 4,703,539 | | 11/1987 | Lautenschläger, Jr. et al. | 16/240 |
| 4,704,766 | | 11/1987 | Almestad | 16/236 |
| 4,799,290 | | 1/1989 | Lautenschläger, Jr. et al. | 16/237 |
| 4,856,141 | | 8/1989 | Sassenberg | 16/250 |
| 4,976,006 | | 12/1990 | Lautenschläger | 16/238 |
| 5,029,364 | * | 7/1991 | Salazar | 16/382 |
| 5,052,077 | | 10/1991 | Lautenschläger, Jr. et al. | 16/238 |
| 5,067,200 | | 11/1991 | Stowell et al. | 16/237 |
| 5,103,532 | | 4/1992 | Youngdale et al. | 16/288 |
| 5,108,165 | | 4/1992 | Rorke et al. | 312/322 |
| 5,327,616 | | 7/1994 | Lautenschläger, Jr. et al. | 16/382 |
| 5,375,297 | | 12/1994 | Lautenschläger, Jr. et al. | 16/249 |
| 5,392,493 | | 2/1995 | Youngdale | 16/237 |
| 5,511,287 | | 4/1996 | Lautenschläger, Jr. et al. | 16/239 |
| 5,577,296 | | 11/1996 | Grass | 16/258 |
| 6,058,564 | * | 5/2000 | Purcell et al. | 16/241 |
| 6,163,930 | * | 12/2000 | King | 16/382 |
| 6,170,121 | * | 1/2001 | Domenig | 16/382 |

FOREIGN PATENT DOCUMENTS

4405349 A1 8/1995 (DE) .

OTHER PUBLICATIONS

Charles McMurray Catalog pp. 93 and 112–114.

* cited by examiner

*Primary Examiner*—Lynne H. Browne
*Assistant Examiner*—John B. Walsh
(74) *Attorney, Agent, or Firm*—Thomas R. Lampe

(57) ABSTRACT

A cabinet door is installed on a frame member of a face frame cabinet employing a mounting bracket attached to a hinge. The mounting bracket is secured to the frame member by a mechanical fastener which is deployed in a recess projecting inwardly from the frame member side. The mounting bracket engages the frame member side and the frame member back and covers an opening formed in the frame member side and a slot located at the frame member back.

20 Claims, 3 Drawing Sheets

CABINET DOOR SECUREMENT SYSTEM FOR A FACE FRAME CABINET

This application is a continuation-in-part of U.S. patent application Ser. No. 09/181,434 filed Oct. 28, 1998. This application is based on and claims the benefits of U.S. Provisional Application Ser. No. 60/129,100, filed Apr. 13, 1999.

TECHNICAL FIELD

This invention relates to a hidden hinge construction employed in a face frame cabinet.

BACKGROUND OF THE INVENTION

Hinges for connecting cabinet doors to cabinets per se are a well known and common expedient. Many hinge arrangements have been devised over the years, including hinge constructions employed with face frame cabinets.

The following patents and materials are believed to be representative of the current state of the prior art in this field: U.S. Pat. No. 5,067,200, issued Nov. 26, 1991, U.S. Pat. No. 4,703,539, issued Nov. 3, 1987, U.S. Pat. No. 5,511,287, issued Apr. 30, 1996, U.S. Pat. No. 4,799,290, issued Jan. 24, 1989, U.S. Pat. No. 4,856,141, issued Aug. 15, 1989, U.S. Pat. No. 5,327,616, issued Jul. 12, 1994, U.S. Pat. No. 5,375,297, issued Dec. 27, 1994, U.S. Pat. No. 5,108,165, issued Apr. 28, 1992, U.S. Pat. No. RE. 36,213, issued Jun. 1, 1999, U.S. Pat. No. RE. 30,717, issued Aug. 25, 1981, U.S. Pat. No. 5,052,077, issued Oct. 1, 1991, U.S. Pat. No. 4,615,072, issued Oct. 7, 1986, U.S. Pat. No. 4,517,706, issued May 21, 1985, U.S. Pat. No. 4,698,877, issued Oct. 13, 1987, U.S. Pat. No. 5,392,493, issued Feb. 28, 1995, U.S. Pat. No. 5,577,296, issued Nov. 26, 1996, U.S. Pat. No. 5,103,532, issued Apr. 14, 1992, U.S. Pat. No. 4,704,766, issued Nov. 10, 1987, and U.S. Pat. No. 4,976,006, issued Dec. 11, 1990. A frameless cabinet door hinge is closed in German Offenlegungsschrift DE 4405349A1. Other hinges of some degree of relevance are shown in pages 93 and 112–114 of the 1998 Charles McMurray Catalog.

The above-identified prior art does not disclose or suggest the combination of structural elements disclosed and claimed herein.

DISCLOSURE OF INVENTION

The present invention relates to a hinge system utilized to apply cabinet doors to face frame cabinets. More particularly, the hinge employed is a hidden hinge, i.e., a hinge not observable from the outside when the cabinet door is closed. The structure of the present invention is characterized by the fact that it can be readily and quickly installed. Furthermore, a strong interconnection is established between the frame member and the door, resisting structural failure resulting from application of external forces to the door. The installation also provides a pleasing appearance when the door is open.

The invention is employed in a face frame cabinet including a cabinet wall and a frame member attached to the cabinet wall and projecting over a portion of the interior of the cabinet. The frame member has a frame member front, a frame member back and a frame member side disposed between the frame member front and the frame member back.

The frame member side has a T-shaped opening formed therein having a vertical opening segment and an intersecting horizontal opening segment. The vertical opening segment communicates with a recess in the frame member located between the frame member front and frame member back and the horizontal opening segment communicates with a slot formed in the frame member back communicating with the recess. The slot has a vertical dimension less than a vertical dimension of the recess.

A hinge is included in the combination, the hinge having a first hinge member attached to a cabinet door and a second hinge member pivotally connected to the first hinge member.

The combination also includes a mounting bracket having a first bracket plate attached to the second hinge member and projecting therefrom. A second bracket plate is attached to the first bracket plate and extends substantially orthogonally thereto, the second bracket plate having a plate opening formed therein.

The first bracket plate is disposed parallel and adjacent to the frame member side and covers the T-shaped opening. The second bracket plate is disposed parallel and adjacent to the frame member back and at least partially covers the slot.

Mechanical fastener means fastens the mounting bracket and the hinge to the frame member. The fastener means comprises a bolt extending through the plate opening and into the slot and a fastener member disposed in the recess and threadedly engaged with the bolt. A portion of the frame member defining the slot is clampingly engaged between the second bracket plate and the fastener member.

Other features, advantages, and objects of the present invention will become apparent with reference to the following description and accompanying drawings.

MODES FOR CARRYING OUT THE INVENTION

Figure 1:
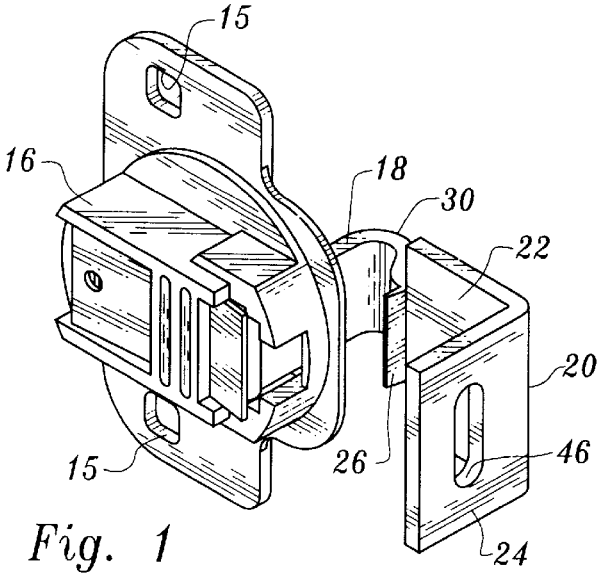
FIG. 1 is a perspective view of a hinge having a mounting jacket attached thereto, the components being shown in the relative positions assumed thereby when a cabinet door associated therewith (not shown) is open.
Figure 2:
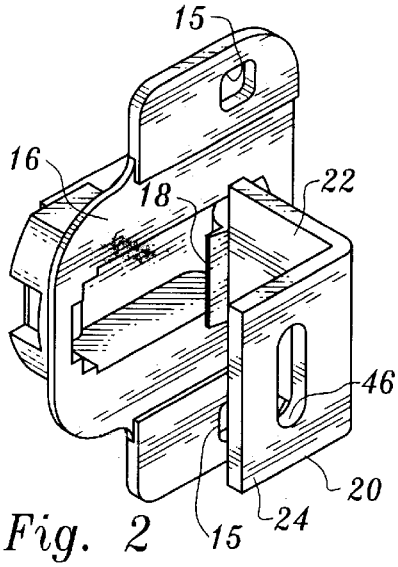
FIG. 2 is a view similar to FIG. 1 but illustrating the relative positions assumed by the components when a cabinet door associated therewith (not shown) is closed.
Figure 4:
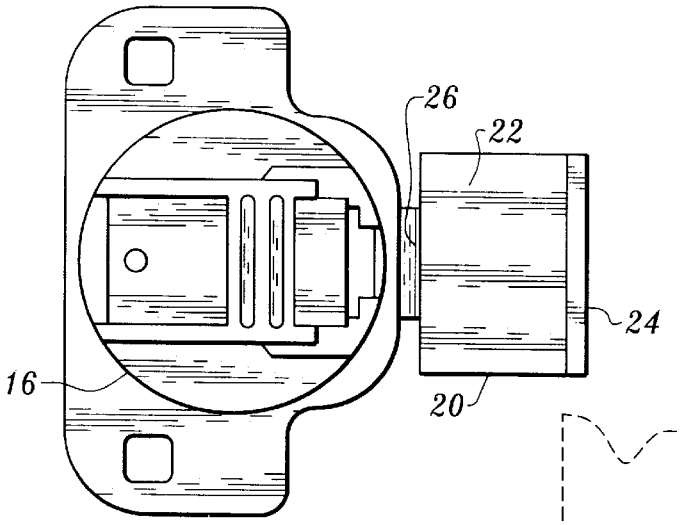
FIG. 4 is a frontal view of the hinge and mounting bracket when in the configuration shown in FIG. 1.
Figure 3:
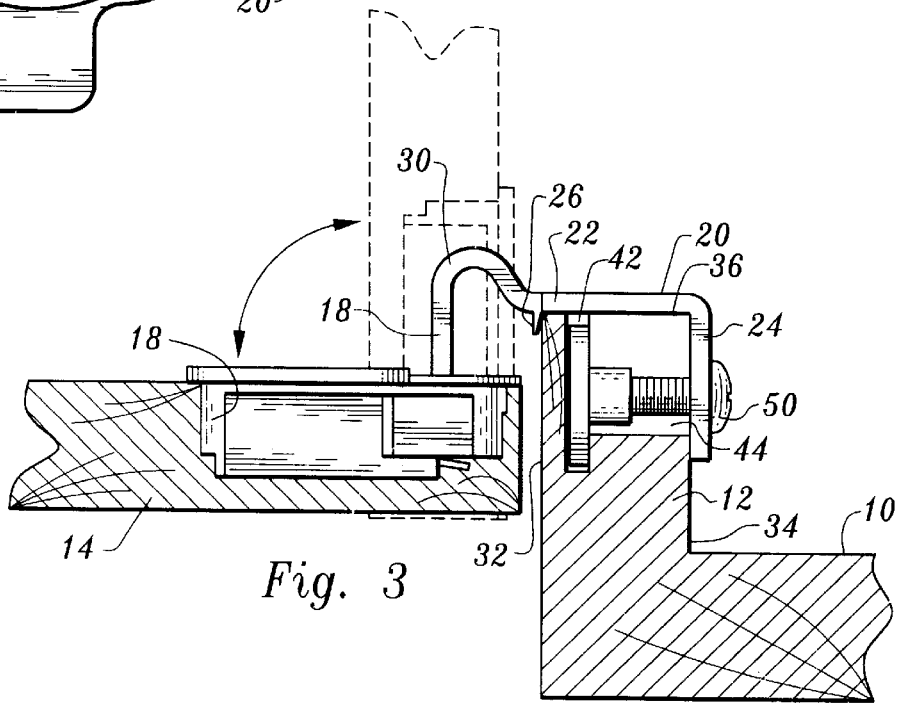
FIG. 3 is a top plan view of the apparatus of the present invention installed on a frame member of a face frame cabinet, portions of the frame member and a cabinet door shown in cross-section and the hinge members illustrated in solid line in relative positions corresponding to those shown in FIG. 1 and in dash line when in relative positions corresponding to those in FIG. 2.
Figure 5:
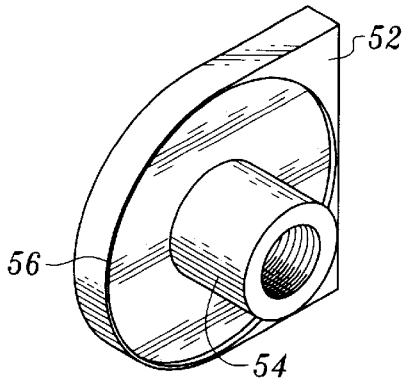
FIG. 5 is an enlarged, perspective view of a fastener member incorporated in the invention.
Figure 8:
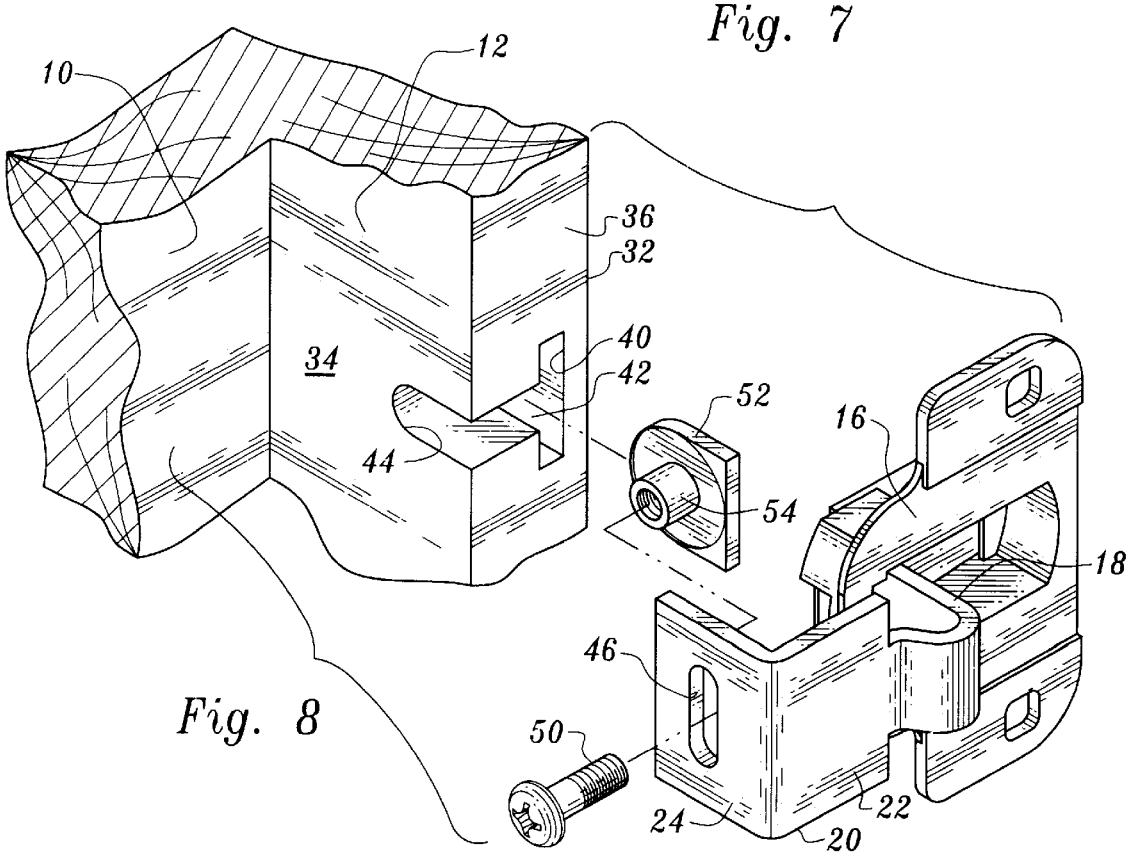
FIG. 8 is an exploded view illustrating installation of mechanical components of the apparatus on a frame member of a face frame cabinet.
Figure 9:
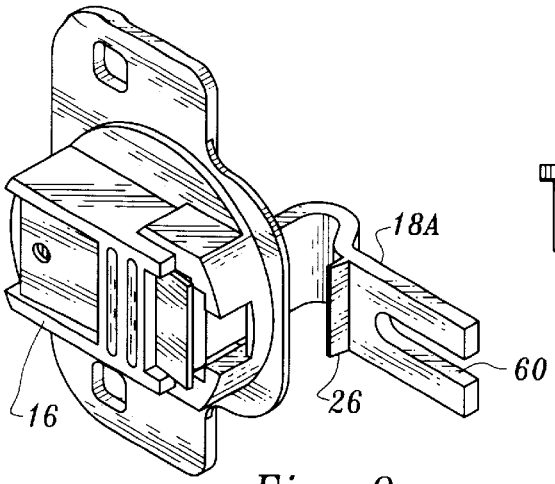
FIG. 9 is a perspective view of a hinge utilized in an alternative embodiment of the invention.
Figure 10:
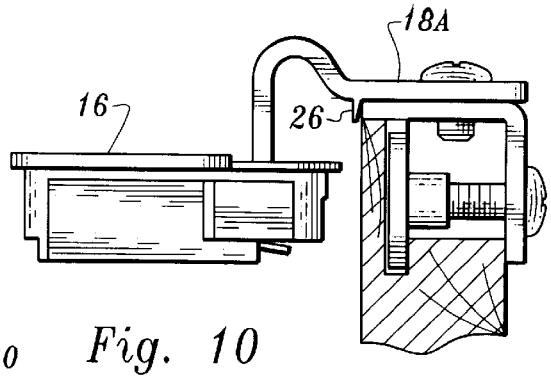
FIG. 10 is a top plan view illustrating a portion of a frame member of a face frame cabinet in cross-section with components of the alternative form of the invention installed thereon.
Figure 11:
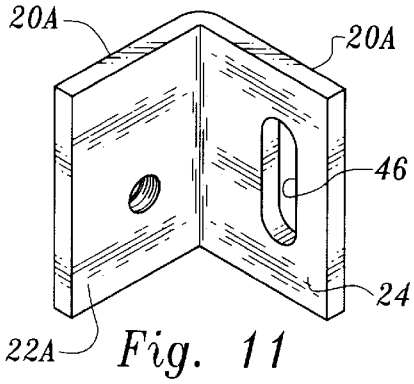
FIG. 11 is a perspective view of a mounting bracket employed in the alternative form of the invention.
Figure 12:
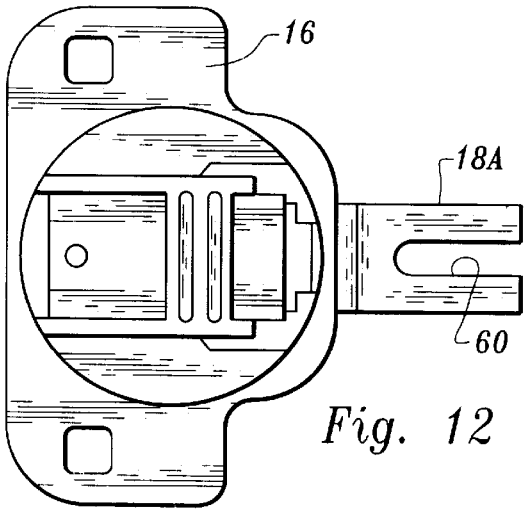
FIG. 12 is a front elevational view of the hinge shown in FIG. 9.
Figure 13:
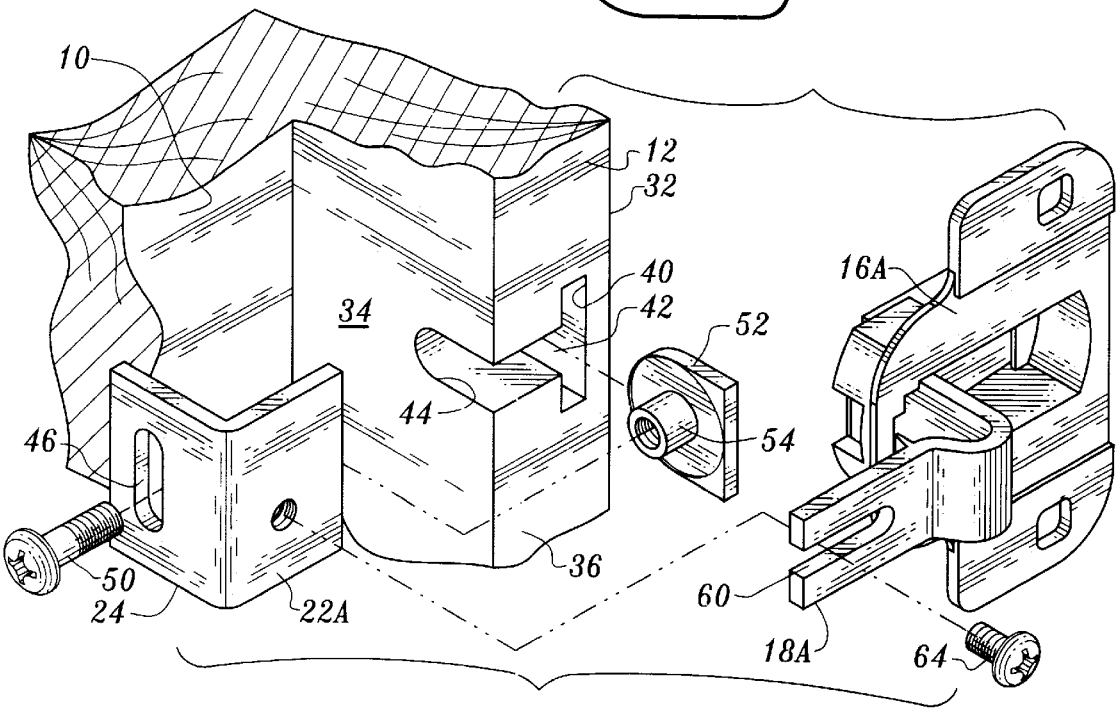
FIG. 13 is a view similar to FIG. 8 but illustrating installation of the alternative form of the invention.

Referring now to FIGS. 1–8, a portion of a face frame cabinet including a cabinet wall 10 and a frame member 12 attached to the cabinet wall is illustrated (FIGS. 3 and 8). FIG. 3 shows a portion of a cabinet door 14 hingedly connected to the frame member in accordance with the teachings of the present invention.

The apparatus of the present invention includes a hinge having a first hinge member 16 and a second hinge member 18 pivotally connected to the first hinge member. The illustrated hinge includes a first hinge member of a cup-like configuration well known in the prior art which is received in a recess formed in a cabinet door as shown in FIG. 3 and secured thereto by screws (not shown). The screws pass through rectangular openings 15 formed in the first hinge member. The rectangular openings are in the form of squares with rounded corners and are bigger than the screw shafts to allow for adjustment of the hinge relative to the door before tightening the screws.

The first and second hinge members are movable between the relative positions shown in FIGS. 1 and 2, the position of the first hinge member 16 in FIG. 1 being that when the hinge door is open, with the position of FIG. 2 corresponding to that when the cabinet door is closed. FIG. 3 shows the two positions, respectively, in solid and dash lines.

A mounting bracket 20 includes a first bracket plate 22 and a second bracket plate 24 extending orthogonal thereto, the mounting bracket being of integral construction in this embodiment.

Second hinge member 18 is rigidly secured to first bracket plate 22, an abutment 26 projecting outwardly from the second hinge member 18 at the location of attachment with first bracket plate 22.

Second hinge member 18 is curved at the end thereof spaced from the first hinge member, the curved end forming an outwardly projecting arch 30 adjacent to the first bracket plate.

Frame member 12 has a frame member front 32, a frame member back 34 and a frame member side 36 disposed between the frame member front and the frame member back.

The frame member side has a T-shaped opening 40 formed therein having a vertical opening segment and an intersecting horizontal opening segment. The vertical opening segment communicates with a recess 42 in the frame member located between the frame member front and frame member back. The horizontal opening segment communicates with a slot 44 formed in the frame member back and communicating with the recess. The slot has a vertical dimension less than the vertical dimension of the recess.

When the mounting bracket is in position on the frame member 12 the first bracket plate 22 is disposed parallel and adjacent to the frame member side and covers the T-shaped opening. The second bracket plate 24 is disposed parallel and adjacent to the frame member back and at least partially covers the slot 44. An opening in the form of an elongated mounting slot 46 is formed in second bracket plate 24.

A mechanical fastener is employed to secure the mounting bracket and the hinge to frame member 12. The fastener includes a threaded bolt 50 which projects through plate opening 46 and into slot 44 of the frame member 12. The slot or opening 46 of the plate allows the mounting bracket to be adjustably positioned relative to the frame member at the time of installation.

Figure 6:
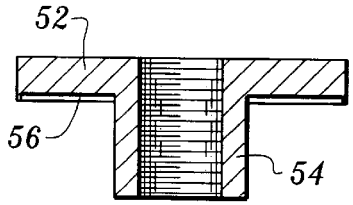
FIG. 6 is a cross-sectional view taken along the line 6—6 of FIG. 7.
Figure 7:
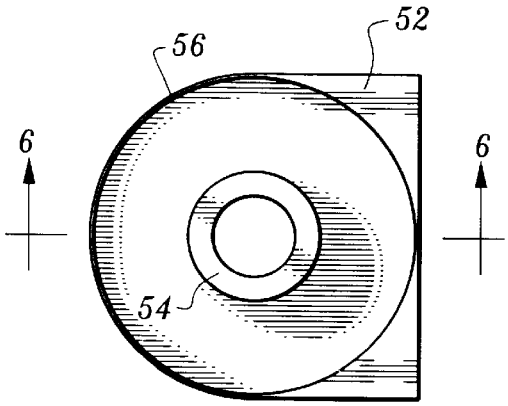
FIG. 7 is an enlarged, front, elevational view of the fastener member.

The other component of the fastener is a fastener plate 52 disposed in recess 42. A boss 54 projects from the fastener plate into slot 44. Internal threads are formed in the boss and fastener plate as shown in FIG. 6. A circular rib 56 is formed on the fastener plate and surrounds the boss. After the structural components are properly positioned the bolt and fastener plate/boss combination are tightened together, urging the fastener plate 52 in the direction of second bracket plate 24 so that the portion of the frame member 12 defining slot 44 is clamped between the plate 52 and the second bracket plate 24. The rib 56 will bite into the material of the frame member to further effect securement.

FIGS. 9–13 illustrate an alternative embodiment of the invention, like components utilizing the same reference numerals as the components of the FIG. 1–8 embodiment. The difference between this embodiment and the first embodiment described above is in the nature of the interconnection between the second hinge member and the first bracket plate. In this second embodiment the second hinge member 16A defines an open ended hinge member slot 60 which receives a threaded bolt 64, the bolt 64 being threadedly engaged with an internally threaded first bracket plate 22A of mounting bracket 20A. This allows adjustment between the mounting bracket and the hinge at the time of installation. The abutment 26, as is the case with respect to the first embodiment, defines a recess with second bracket plate 24 receiving frame member side 36. The recess size corresponds to the distance between the frame member front and the frame member back, providing additional stability.

What is claimed is:

1. In combination:

a face frame cabinet including a cabinet wall and a frame member attached to said cabinet wall and projecting therefrom over a portion of the interior of said cabinet, said frame member having a frame member front, a frame member back and a frame member side disposed between said frame member front and said frame member back, said frame member side having a T-shaped opening formed therein having a vertical opening segment and an intersecting horizontal opening segment, said vertical opening segment communicating with a recess in said frame member located between said frame member front and frame member back and said horizontal opening segment communicating with a slot formed in said frame member back, said slot having a vertical dimension less than the vertical dimension of said recess;

a hinge including a first hinge member attached to a cabinet door and a second hinge member pivotally connected to said first hinge member;

a mounting bracket including a first bracket plate attached to said second hinge member and projecting therefrom and a second bracket plate attached to said first bracket plate and extending substantially orthogonal thereto, said second bracket plate having a plate opening formed therein, said first bracket plate disposed parallel and adjacent to said frame member side and covering said T-shaped opening and said second bracket plate disposed parallel and adjacent to said frame member back and at least partially covering said slot; and fastener means fastening said mounting bracket and said hinge to said frame member, said fastener means comprising a bolt extending through said plate opening and into said slot and a fastener member disposed in said recess and threadedly engaged with said bolt, a portion of said frame member defining said slot clampingly engaged between said second bracket plate and said fastener member.

2. The combination according to claim 1 wherein said fastener member includes a fastener plate bearing against said portion of said frame member and a threaded boss projecting from said fastener plate into said slot.

3. The combination according to claim 1 wherein said plate opening comprises a vertically disposed, elongated mounting slot.

4. The combination according to claim 1 additionally comprising an abutment attached to said second hinge member and said first bracket plate at the location of attachment of said second hinge member and said first bracket plate, said abutment being spaced from said second bracket plate and defining a recess therewith receiving said frame member side and substantially corresponding to the distance between said frame member front and said frame member back.

5. The combination according to claim 1 wherein said second hinge member has a curved end spaced from said first hinge member, said curved end forming an outwardly projecting arch adjacent to said first bracket plate.

6. The combination according to claim 1 additionally including releasable connector means releasably attaching said first bracket plate and said second hinge member.

7. The combination according to claim 6 wherein said releasable connector means comprises a threaded connector threadedly engaged with threads formed in either said first mounting plate or said second hinge member.

8. The combination according to claim 7 wherein said second hinge member defines an open ended hinge member slot receiving said threaded connector and wherein the threads are formed in said first mounting plate.

9. The combination according to claim 2 wherein said fastener plate includes a rib spaced from said threaded boss engaging said portion of said frame member.

10. The combination according to claim 1 wherein said first hinge member defines rectangular holes for loosely receiving mechanical fasteners.

11. A hinge mounting assembly for a face frame cabinet including a cabinet wall and a frame member attached to said cabinet wall and projecting therefrom over a portion of the interior of said cabinet, said frame member having a frame member front, a frame member back and a frame member side disposed between said frame member front and said frame member back, said frame member side having a T-shaped opening formed therein having a vertical opening segment and an intersecting horizontal opening segment, said vertical opening segment communicating with a recess in said frame member located between said frame member front and frame member back and said horizontal opening segment communicating with a slot formed in said frame member back, said slot having a vertical dimension less than the vertical dimension of said recess, said hinge mounting assembly comprising, in combination;

a hinge including a first hinge member for attachment to a cabinet door and a second hinge member pivotally connected to said first hinge member;

a mounting bracket including a first bracket plate attached to said second hinge member and projecting therefrom and a second bracket plate attached to said first bracket plate and extending substantially orthogonal thereto, said second bracket plate having a plate opening formed therein, said first bracket plate for positioning parallel and adjacent to a frame member side and for covering T-shaped opening in the frame member side and said second bracket plate for positioning parallel and adjacent to a frame member back and for at least partially covering a slot in the frame member back; and fastener means for fastening said mounting bracket and said hinge to said frame member, said fastener means comprising a bolt for extending through the plate opening and into the slot and a fastener member for positioning in a recess in the frame member and threadedly engageable with said bolt.

12. The combination according to claim 11 wherein said fastener member includes a fastener plate for bearing against a portion of said frame member defining the slot and a threaded boss projecting from said fastener plate.

13. The combination according to claim 11 wherein said plate opening comprises a vertically disposed, elongated mounting slot.

14. The combination according to claim 11 additionally comprising an abutment attached to said second hinge member and said first bracket plate at the location of attachment of said second hinge member and said first bracket plate, said abutment being spaced from said second bracket plate and defining a recess therewith for receiving the frame member side and substantially corresponding to the distance between the frame member front and the frame member back.

15. The combination according to claim 11 wherein said second hinge member has a curved end spaced from said first hinge member, said curved end forming an outwardly projecting arch adjacent to said first bracket plate.

16. The combination according to claim 11 additionally including releasable connector means releasably attaching said first bracket plate and said second hinge member.

17. The combination according to claim 16 wherein said releasable connector means comprises a threaded connector threadedly engaged with threads formed in either said first mounting plate or said second hinge member.

18. The combination according to claim 17 wherein said second hinge member defines an open ended hinge member slot receiving said threaded connector and wherein the threads are formed in said first mounting plate.

19. The combination according to claim 12 wherein said fastener plate includes a rib spaced from said threaded boss for engaging the portion of the frame member defining the slot.

20. The combination according to claim 11 wherein said first hinge member defines rectangular holes for loosely receiving mechanical fasteners.

* * * * *